US005322176A

United States Patent [19]

Dubach

[11] Patent Number: 5,322,176

[45] Date of Patent: Jun. 21, 1994

[54] PLASTIC SNAP HINGE WITH A FLEXIBLE ELEMENT GENERATING THE SNAP ACTION

[75] Inventor: Werner F. Dubach, Maur, Switzerland

[73] Assignee: Sreatechnic AG, Switzerland

[21] Appl. No.: 939,524

[22] Filed: Sep. 1, 1992

Related U.S. Application Data

[63] Continuation-in-part of Ser. No. 665,337, Mar. 6, 1991, abandoned.

[30] Foreign Application Priority Data

Mar. 12, 1990 [CH] Switzerland ..... 00785/90

[51] Int. Cl.[5] ..... B65D 47/08

[52] U.S. Cl. ..... 215/235; 220/254; 220/335; 220/339; 222/556

[58] Field of Search ..... 215/235, 237; 220/254, 220/259, 337, 339, 335; 222/505, 517, 556

[56] References Cited

U.S. PATENT DOCUMENTS

| | | | |
|---|---|---|---|
| 2,630,239 | 3/1953 | Paull et al. . | |
| 2,894,654 | 7/1959 | Löhrer | 215/235 |
| 3,551,940 | 1/1971 | Edison | 220/339 X |
| 3,629,901 | 12/1971 | Wolf . | |
| 4,386,714 | 6/1983 | Roberto et al. | 215/235 X |
| 4,414,705 | 11/1983 | Ostrowsky | 220/339 X |
| 4,703,853 | 11/1987 | Byrns | 220/339 X |
| 4,753,351 | 6/1988 | Guillin | 220/339 X |
| 4,911,324 | 3/1990 | Dubach . | |
| 5,065,911 | 11/1991 | Rohr et al. | 222/517 |
| 5,127,537 | 7/1992 | Graham | 220/339 |
| 5,257,708 | 11/1993 | Dubach | 220/335 |

*Primary Examiner*—Allan N. Shoap
*Assistant Examiner*—Vanessa Caretto
*Attorney, Agent, or Firm*—Speckman, Pauley & Fejer

[57] ABSTRACT

A plastic snap hinge having a lower part and a cap connected to each other by a single or multi-part main hinge and a flexible element which generates a snap action. The flexible element is connected to the lower part and the cap by film hinges integral with the lower part and the cap. The flexible element has a shape which is folded repeatedly and which is such that a straight line penetrating the flexible element intersects the flexible element at least at three points. The construction allows the design of plastic tops with a flat, cap having an extremely large angle of opening and a strong snap action.

7 Claims, 2 Drawing Sheets

PLASTIC SNAP HINGE WITH A FLEXIBLE ELEMENT GENERATING THE SNAP ACTION

This is a continuation-in-part patent application of a co-pending U.S. patent application having Ser. No. 07/665,337, filed Mar. 6, 1991, now abandoned.

BACKGROUND OF THE INVENTION

1. Field of the Invention

This invention relates to a single piece plastic closure with a snap hinge having two parts connected by at least one hinge, and a flexible element generating the snap action, which is hingedly connected to the two parts of the closure.

2. Description of Prior Art

Plastic snap hinges for closures can be roughly classified into two types, namely those where the snap effect is generated by a tension element and those where it is generated by an elastically flexible element. This invention relates to a closure with a plastic snap hinge of the second type.

Conventional elastically flexible elements have a shape in the form of a letter "U" or "L", as, for example, is known from U.S. Pat. No. 4,911,324 or U.S. Pat. No. 2,630,239. The size of the elements is essentially determined by the spring path and the desired spring force. However, particularly in connection with the use of plastic tops, other marginal conditions which greatly affect the geometry of a plastic snap hinge are opposed to this. Conventional flexible elements cannot be used, particularly when employing tops with relatively large pouring spouts and a relatively flat lid. In the case of an L-shaped flexible element, the leg extending through the cover of the lid cannot be made sufficiently long, because otherwise it would extend into the sealing area of the pouring spout. A U-shaped flexible element cannot be made sufficiently large, because the low height of the lid does not provide enough space to accept the flexible element.

Another solution is taught by U.S. Pat. No. 3,629,901 where the elastically flexible element is parted in two sections of U-shape form as corrugated hinge strips, while an intermediate inflexible section remains. Such a hinge has its most relaxed position when the corrugated hinge strips are at least curved. This condition occurs in a position between opened and closed.

SUMMARY OF THE INVENTION

It is one object of this invention to provide a flexible element which can be used in connection with plastic hinges which is fully integrated into the form of a single piece plastic closure having a flat top cover part and a lower part with a circumferential wall being vertical to the flat top cover in the area of the hinge.

This object is achieved in accordance with one embodiment of this invention by a plastic snap hinge having two parts connected by at least one hinge and a flexible element generating a snap action. The flexible element is hingedly connected to the two parts. The flexible element has a shape whereby at least one straight line can be extended through the flexible element, penetrating the flexible element at least at three different points.

A significant benefit of the hinge construction in accordance with this invention is that it provides better flexibility than known hinge constructions thus permitting closures with thinner walls to save plastic material and reduce costs.

Further embodiments in accordance with the invention and their purpose will be explained in the description below.

Two preferred embodiments of this invention are illustrated in the drawings and will be explained in the following description.

DESCRIPTION OF PREFERRED EMBODIMENTS

Figure 2:
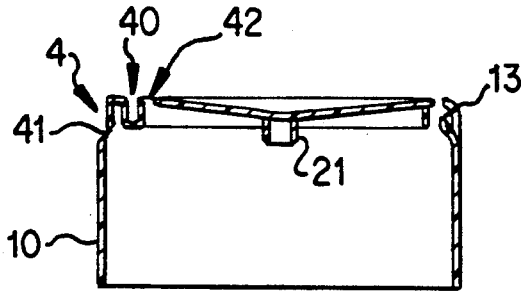
FIG. 2 is a longitudinal section of the flexible element of the top, as shown in FIG. 1, in a closed position.

A plastic top is shown in FIGS. 1 to 5, which is suitable for use with a plastic container 30 having only a small pouring spout 31. Such containers are particularly used in connection with cosmetics which are applied directly to the skin, such as suntan lotions or body lotions. This requires that a cap 2 of the top can be rotated about at least 180°, with respect to a closed position of the top.

The top comprises a lower part 1 and the cap 2, which are pivotally connected with each other with two film hinges 3 positioned in a straight line. A flexible element 4 is positioned between the two film hinges 3 and generates a spring force necessary for the snap action.

Figure 4:
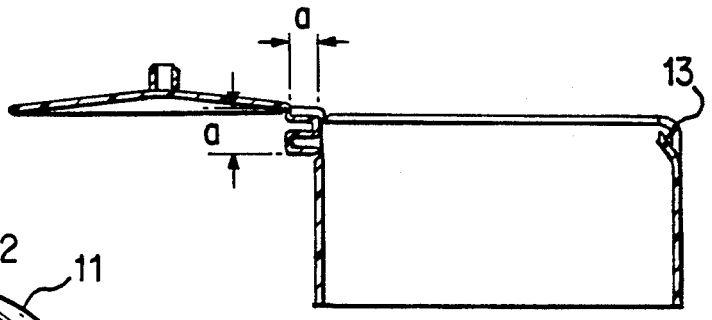
FIG. 4 is a view of the flexible element shown in FIG. 2, in a fully open position.
Figure 1:
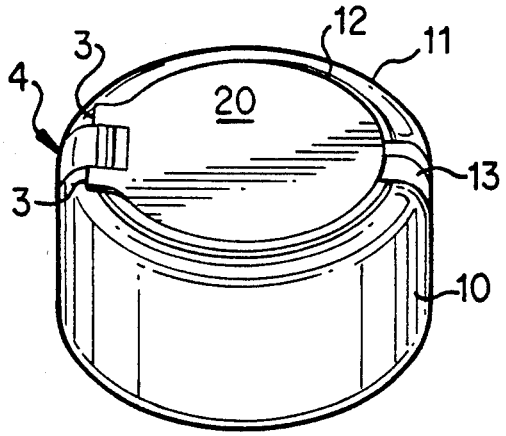
FIG. 1 is a perspective view of a plastic top and the snap hinge in accordance with one embodiment of this invention.
Figure 5:
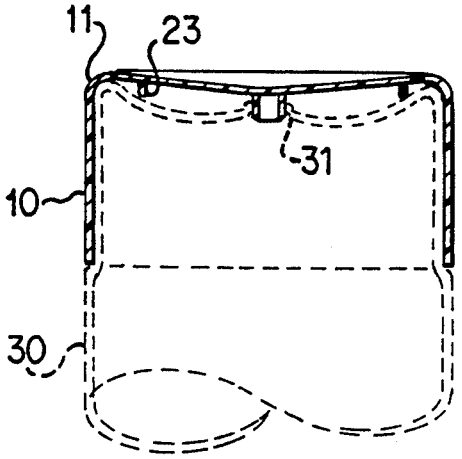
FIG. 5 is a cross-sectional view, crosswise to the previously illustrated sectional planes of the top in accordance with FIG. 1, placed on a container.

The lower part 1 comprises an annular, circumferential wall 10 having a conically tapering collar 11. The pouring spout 31 of the container 30 is disposed within the lower part 1 of the closure. A gap 12 remains between the cap 2 and the lower part 1, even in the closed position. This is required so as to make it possible to injection-mold the top in the closed position. The collar 11 of the lower part 1 is depressed in an area opposite the film hinge 3 to form a recess 13 which makes it possible to push the cap 2 upwards with a thumb, beyond the unstable equilibrium position, after which the cap snaps into a completely opened position, as shown in FIG. 4.

Sealing the cap 2 with the pouring spout 31 of the container 30 is accomplished with a sealing tang 21, injection-molded to the underside of the cover 20. To enhance the seal and in particular the closing strength, the tang 21 may have at least one circular seal ring 22. For reasons of appearance as well as for increasing the stiffness, the cover 20 in accordance with this embodiment of the invention is formed upwardly concave in this case. A plurality of support cams 23 may be provided on the underside of the cover 20, for defining the relative position of the cap 2 with respect to the container 30. In the assembled state of the top and closed position of the cap 2, the support tangs 23 rest on the container 30.

In this embodiment, the flexible element 4 can also be ejected from a mold in the closed position of the top. In cross section, the flexible element 4 has the shape of the letter "U" and of a following, upside-down letter "L". The opening 40 of the U-shaped part extends exactly in the extraction direction of the mold tool. The flexible element 4 is connected with the cap 2 and the lower part 1 with two flexible element hinges 41 and 42 integral with circumferential wall 10 of lower part 1 and the flat top of cap 2. The hinge 41 forms the connection between the circumferential wall 10 and the flexible element 4 and is located approximately at the level of the upper edge of the container 30, on which the top has been mounted.

Figure 3:
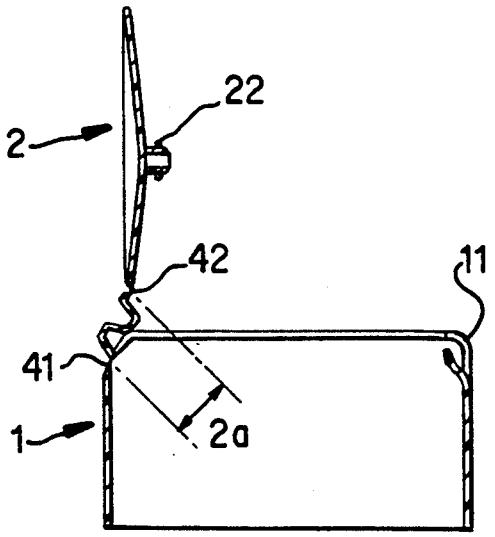
FIG. 3 is a view of the flexible element shown in FIG. 2, in a half-opened position.

The hinge 42 connects the cap 2 to the flexible element 4. As shown most distinctly in FIG. 4, the two flexible element hinges 41 and 42 are at the same distance from the fixed film hinge 3. In such arrangement, the minimal distance between the two flexible element hinges 41 and 42 is $a \cdot \sqrt{2}$, if the distance from each hinge 41, 42 to the film hinge 3 is equal to "a". In the unstable equilibrium position, such as shown in FIG. 3, the maximum distance between the two hinges 41 and 42 is attained and is exactly $2 \cdot a$. This is the case when the two hinges 41, 42 are located vertically on top of each other.

Figure 7:
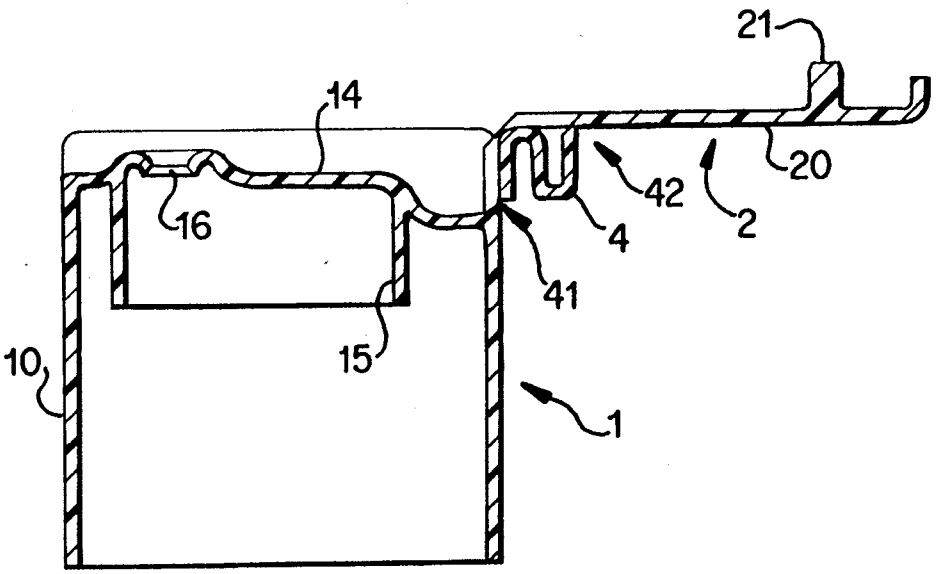
FIG. 7 is a cross-sectional view in accordance with FIG. 6, with the flexible element in a completely open position.
Figure 6:
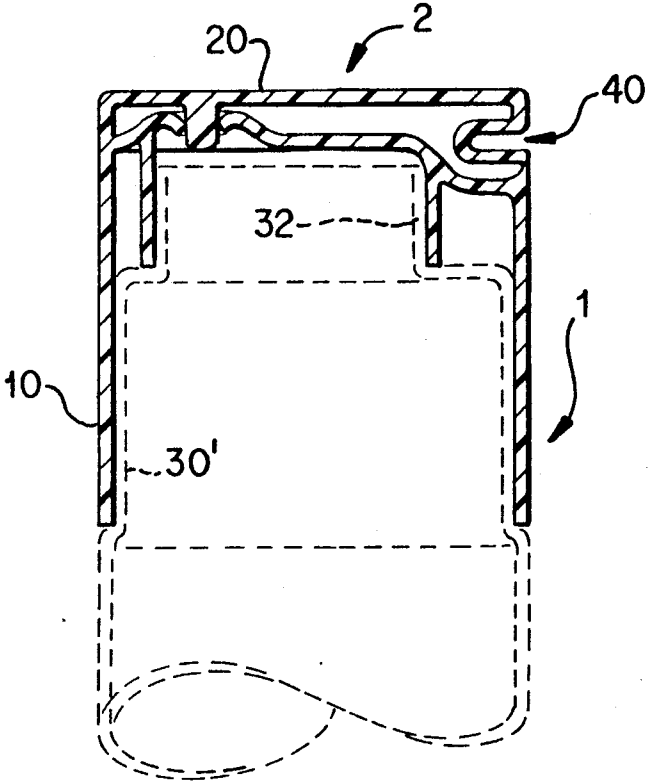
FIG. 6 is a cross-sectional view, of another embodiment of the plastic top with a differently positioned flexible element, in a closed position.

A further embodiment of the invention is shown in FIGS. 6 and 7, and has a second top. It essentially has the same characteristics as the previously described top illustrated in FIGS. 1 to 5. However, the top of FIGS. 6 and 7 is suited for use with a container 30', shown in dashed lines, with a container neck 32. Accordingly, the lower part 1 must be designed in such a way that it can enclose the container neck 32. For this purpose, the side wall 10 of the lower part 1 abutting against the container 30' has a cover 14 with a vertically downward directed annular wall 15, which surrounds and seals the container neck 32 of the container 30'. A spout 16 has been formed in the cover 14 of the lower part 1 within the area defined by the annular wall 15. It is closed by a tang 21 formed on the cover 20 of the cap 2. In this case, the seal is not made between the container and the cap 2 but, as is customary with plastic tops, between the lower part 1 and the cap 2. Of course, the cover 14 of the lower part 1 does not permit a unified manufacture of the top. It is injection-molded in the completely open position, as shown in FIG. 7. This is possible because the flexible element 4 can be positioned in such a way that it can be ejected from a mold even in the completely open position of the top. The opening 40, visible from the outside in the closed position of the top, is now located in the side wall 10 of the lower part 1. However, in the completely open position of the top the flexible element 4 is flipped outward by 90° around the hinge 41. Now the opening 40 extends vertically downward and thus parallel to the side wall 10 and in the extraction direction of the injection mold.

In this embodiment, too, the same geometry of the flexible element has been used, as the embodiment shown in FIGS. 1 to 5. Although only one general shape, and most likely the one used most often, has been illustrated, such important aspect of this invention can be expressed more generally, and it is of course obvious, that the partial sections of the flexible element 4 need not necessarily extend parallel. Thus, instead of a U-shaped part there can be a V-shaped part. Also, the partial sections which in this case are straight, can be arched. In principle, it is only necessary that the flexible element 4 be designed accordion-like, so that it is always possible to extend a straight section which penetrates the flexible element at three different points. Only those flexible elements which meet this geometric definition provides an accordion-like shape, which allows great expansion in a small space and provides a large force for the snap effect.

I claim:

1. A single piece plastic snap hinge closure comprising:

a lower part having a circumferential wall and a cap comprising a flat top surface part, said lower part and said cap being connected to each other by at least one film hinge defining a pivoting axis of said closure, said lower part forming a pouring spout opening;

a flexible element generating a snap action, said film hinge situated on a line defined by an intersection of an outer surface of the circumferential wall and said flat top surface part of the cap when the closure is in a closed position;

said flexible element connected to said lower part by a first flexible element film hinge integral with said outer surface of the circumferential wall and to said cap by a second flexible element film hinge integral with said flat top surface part of said cap;

said flexible element comprising a plurality of partial sections forming a shape of an "S", said "S" shaped flexible element having two outermost legs being equal in size to each other and interconnected by a central portion, said legs of said "S" shaped flexible element being one of perpendicular and parallel to said outer surface of said circumferential wall in an open position of said closure and being the other of perpendicular and parallel to said outer surface of said circumferential wall in said closed position of said closure; and said flexible element in the open position of said closure disposed as much outside a shape defined by said circumferential wall and said flat top surface of said cap as it is inside said shape int he closed position of said closure.

2. A single piece plastic closure in accordance with claim 1, wherein an upper leg of said "S"-shaped flexible element is flush with said flat cover of said cap in a completely closed position of the closure.

3. A single piece plastic closure in accordance with claim 1, wherein one leg of said "S"-shaped flexible element is flush with said circumferential wall of said lower part in a completely closed position of the closure.

4. A single piece plastic closure in accordance with claim 2, wherein said flexible element is symmetricaly arranged between two said film hinges connecting said lower part and said cap of the closure.

5. A single piece plastic closure in accordance with claim 2, wherein said film hinge connecting said lower part with said cap and said flexible element film hinges connecting said flexible element with said lower part and said cap are all parallel to each other.

6. A single piece plastic closure in accordance with claim 3, wherein said flexible element is symmetricaly arranged between two said film hinges connecting said lower part and said cap of the closure.

7. A single piece plastic closure in accordance with claim 3, wherein said film hinge connecting said lower part with said cap and said flexible element film hinges connecting said flexible element with said lower part and said cap are all parallel to each other.

* * * * *

UNITED STATES PATENT AND TRADEMARK OFFICE

CERTIFICATE OF CORRECTION

PATENT NO. : 5,322,176

DATED : June 21, 1994

INVENTOR(S) : Werner F. DUBACH

It is certified that error appears in the above—identified patent and that said Letters Patent is hereby corrected as shown below:

On the title page, item [73]:
The name of the Assignee has been misspelled. The correct spelling is CREATECHNIC AG.

Signed and Sealed this

Twenty-fourth Day of January, 1995

*Attest:*

*Attesting Officer*

BRUCE LEHMAN

*Commissioner of Patents and Trademarks*